United States Patent [19]

Nitta

[11] Patent Number: 4,778,379

[45] Date of Patent: Oct. 18, 1988

[54] ROD-SHAPED PIEZOELECTRIC GAS IGNITER

[75] Inventor: Tomio Nitta, Yokohama, Japan

[73] Assignee: Tokai Corporation, Kanagawa, Japan

[21] Appl. No.: 90,282

[22] Filed: Aug. 28, 1987

[30] Foreign Application Priority Data

Sep. 12, 1986 [JP] Japan ..... 61-139323[U]

[51] Int. Cl.[4] ..... F23Q 7/12

[52] U.S. Cl. ..... 431/255

[58] Field of Search ..... 431/255, 132

[56] References Cited

U.S. PATENT DOCUMENTS 4,150,940 4/1979 Heller et al. ..... 431/255

4,516,933 5/1985 Buzzi ..... 431/255

*Primary Examiner*—Carroll B. Dority, Jr.

*Attorney, Agent, or Firm*—Armstrong, Nikaido, Marmelstein & Kubovcik

[57] ABSTRACT

Disclosed is a rod-shaped piezoelectric igniter comprising a liquefied gas reservoir section equipped with an ejection valve, which is responsive to operation of an acutating lever for ejecting gas; and an ignition mechanism section including an ignition nozzle functioning as an ignition electrode with a counter electrode projecting inward from a metal hollow cylinder encircling the ignition nozzle, a piezoelectric generator mechanism partly exposed to permit access thereto for pushing operation, the minus terminal of the piezoelectric generator being responsive to the pushing operation for operating the actuating lever, an electrically conductive conduit connecting the ignition nozzle to the ejection nozzle, and a lead conductor connecting the metal hollow cylinder to the plus terminal of the piezoelectric generator mechanism. This arrangement permits the full automatization of assembling work, making it unnecessary to use a minus or ground lead conductor, which is substituted by the electrically conductive conduit connected to the minus terminal of the piezoelectric generator through the ejection nozzle and associated lever.

2 Claims, 3 Drawing Sheets

ROD-SHAPED PIEZOELECTRIC GAS IGNITER

BACKGROUND OF THE INVENTION

1. Field of the Invention

The present invention relates to a rod-shaped piezoelectric igniter having an ignition nozzle extended long enough to make it easy to have access to an object to be ignited.

2. Related Art

A conventional rod-shaped piezo-electric igniter is assembled by putting together a liquefied gas reservoir, a piezoelectric generator mechanism, an ejection nozzle, a plus lead conductor, a ground lead conductor, a liquefied gas conduit and other parts in two longitudinal split casing counterparts combined together.

Assembling all the parts in two casing counterparts, however, makes it difficult to automatize assembling work. Also, the conventional structure requires a minus or ground lead conductor in addition to a plus lead conductor, and accordingly extra work and cost are involved.

In view of the above, one object of the present invention is to provide an improved structure of rod-shaped piezo-electric igniter which permits the automatization of assembling work, and reduction of number of required parts and accordingly assembling stage, and hence reduction of manufacturing cost.

SUMMARY OF THE INVENTION

To attain this object, a rod-shaped piezo-electric igniter according to the present invention comprises: a reservoir casing having joint means; two longitudinal split casing counterparts to be together combined and a metal hollow cylinder having an electrode projecting inward, said metal hollow cylinder being fixed to one end of the combined casing counterparts, the other end of the combined casing counterparts having counter joint means for releasably coupling with the joint means of the reservoir casing; a liquefied gas reservoir section contained in the reservoir casing and equipped with an ejection valve, which is responsive to operation of a lever for ejecting gas; and an ignition mechanism section contained in the combined casing counterparts and the metal hollow cylinder, said ignition mechanism section including an ignition nozzle functioning as an igniting electrode in the opposite relationship with the counter electrode projecting inward from the metal hollow cylinder, a piezoelectric generator mechanism partly extending into the reservoir casing, and partly exposed to permit access thereto for pressing operation, the minus terminal of the piezoelectric generator being responsive to the pressing operation for operating the lever, an electrically conductive conduit connected to the ignition nozzle at one end of the conduit, and a lead conductor connected to the metal hollow cylinder at one end of the lead conductor and to a plus terminal of the piezoelectric generator mechanism at the other end of the conductor, thus permitting integration of the liquefied gas reservoir section and the ignition mechanism section with the rear part of the piezoelectric generator mechanism fitted in the reservoir section in proper position, and with the other end of the electrically conductive coduit connected to the tip end of the ejection nozzle, whereby the piezoelectric generator mechanism is responsive to the push to the exposed part thereof for ejecting the gas from the ejection nozzle and at the same time causing its minus terminal to enter into electric contact with the electrically conductive conduit through the agency of the lever. According to a preferred embodiment the joint means of the reservoir casing comprises a square nail projection and an elongated cross recess, and the counter joint of the combined casing counterparts comprises a square recess and an elongated cross ridge.

Other objects and advantages of the present invention will be better understood from the following description of a sole preferred embodiment of the present invention, which is shown in the accompanying drawings:

PREFERRED EMBODIMENT OF THE INVENTION

Figure 1:
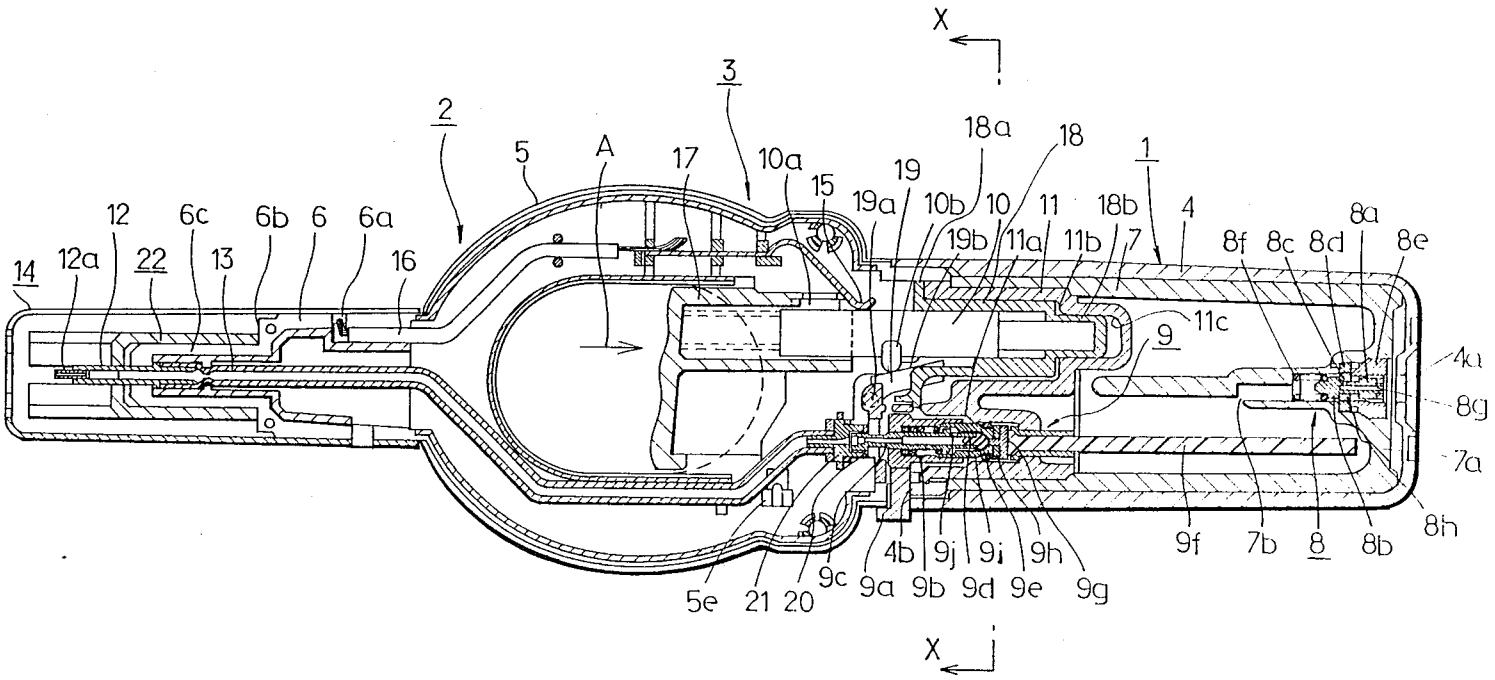
FIG. 1 is a longitudinal section, showing a rod-shaped piezoelectric igniter according the the present invention.

A rod-shaped piezoelectric igniter according to a preferred embodiment of the present invention is described below. FIG. 1 is a longitudinal section, showing the rod-shaped piezoelectric igniter. It comprises a liquefied gas reservoir section 1 including a tank 7 containing a liquefied gas and equipped with a gas ejection valve 9 responsive to the operation of an associated lever 19 for ejecting gas, and an ignition mechanism section 2 including a piezoelectric generator mechanism and an ignition nozzle functioning as an igniting electrode to which the liquefied gas will be supplied from the ejection nozzle for burning. As shown, the ignition mechanism section 2 is releasably fixed to the liquefied gas section 1 with the aid of joint means **5*b*. When the ignition mechanism section and the liquefied gas sectionare combined together, the piezoelectric generator mechanism 10 is automatically put in proper position, and the rear end of the electrically conductive conduit 13 extending from the ignition nozzle 12 is connected to the nozzle 9*c* of the ejection nozzle 9. In use, an operating cap 17 is pushed, and then a plus terminal 10*a* of piezoelectric generator mechanism 10 enters into electric contact with the terminal 15 of plus lead conductor 16 connected to a metal hollow cylinder 14, which is attached to the casing extention 6. At the same time a minus or ground terminal 10*b* pushes the operating lever 19 to cause ejection of gas from the ejection valve 9, and then the minus terminal 10*b* enters into electric contact with an electrically conductive conduit 13 through the agency of the operating lever 19, thus causing an electric arc to appear between the ignition nozzle 12 and an electrode 14*b* (See FIG. 5) projecting inward from the metal cylinder 14** for burning the ejected gas.

As shown, in the liquefied gas reservoir section 1, the tank 7 is included in a reservoir casing 4, and it has an injection valve 8 provided to its bottom end. The rear end of the piezoelectric generator mechanism 10 and the ejection nozzle 9 are snuggly put in the big and small recesses of the reentrant ceiling plate of the tank 7.

Figure 4:
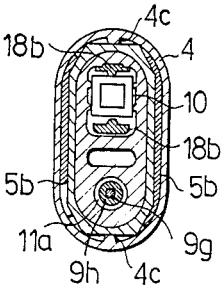
FIG. 4 is a sectional view taken along line "X"—"X" in FIG. 1.

The reservoir casing 4 has a shape, in section, of parallel lines and circular arcs (See FIG. 4), and it has an injection hole 4a at the bottom center thereof. Also, it has a slot **4*b* cut along the circumference thereof on which the ignition mechanism section is jointed to the reservoir section, and a finger-operative piece appears from the slot 4*b* for operating a control ring 9*a*, thereby controlling the flow rate of the liquefied gas from the ejection nozzle 9. The reservoir casing 4 which is oval in section, has longitudinal ridges 4*c* on the opposite circular arc inside surfaces (See FIG. 4**) , and lateral ridges (not shown) on the opposite straight inside surfaces near the ceiling end of the reservoir casing.

Figure 2:
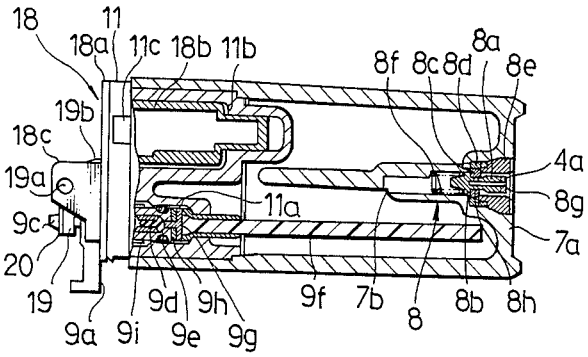
FIG. 2 shows, partly in section, the reservoir section removed from the igniter.

FIG. 2 shows, partly in section, the reservoir section 1 with its casing removed. As shown, the tank 7 has an injection valve **8*a*, which will face an injection hole 4*a*made in the reservoir casing 4 when the tank 7 is put in the reservoir casing 4. The top closure 11 is applied to the ceiling end of the reservoir, leaving between the closure and the reservoir casing narrow space enough to receive the joint 5*b*** of the ignition mechanism section.

The injection valve 8 comprises a valve stem **8*a* slidably fitted in the center hole of the bottom plate 7*a* of the tank, an annular valve seat 8*c* on which the expanded head 8*b* of the valve stem rests, a control ring 8*d* fitted around the valve seat 8*c* and a valve closure 8*e* around the rear end of the valve stem. A compressed spring 8*f* pushes the valve stem 8*a* backward all the time. When the tank is loaded with the liquefied gas, the injection valve stem 8*a* is pushed inward, and then liquefied gas is allowed to flow into the inside of the tank through the longitudinal injection channel 8*g* and lateral channel 8*h* of the valve stem 8*a* and around the head of the valve stem and finally through the inlet 7*b***.

The top closure 11 has small and big recesses **11*a* and 11*b* The rear end of the ejection valve 9 is put in the small recess of the top closure, and the rear end of the piezoelectric generator mechanism 10 is fitted in the big recess of the top closure with a bracket 18 intervening there between. A square recess 11*c*** is provided to each side of the upper extension of the reservoir.

Figure 7:
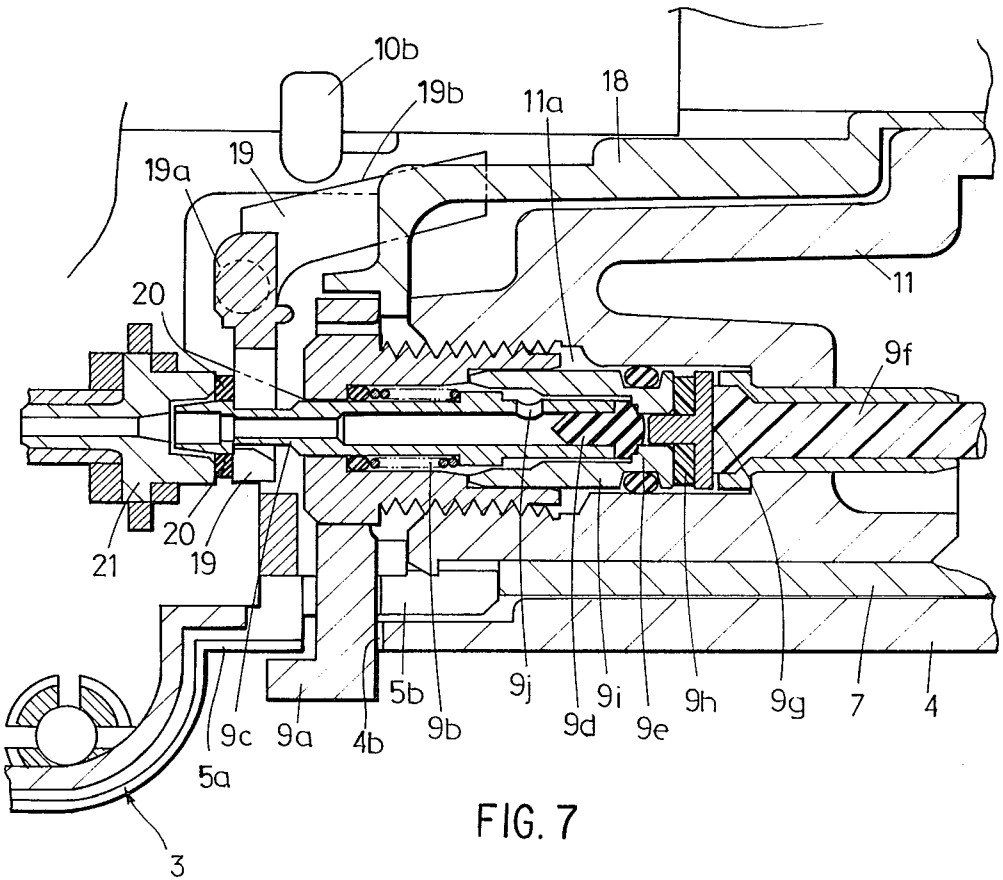
FIG. 7 is a sectional view showing, in enlarged detail, the ejector nozzle and associate elements of FIG. 1.

The bracket 18 is composed of an annular support **18*a* resting on the outer edge of the top closure of the tank, a piezoelectric generator support 18*b* extending backward from the annular support and fitted in the big recess 11*b* of the top closure, and a lever support 18*c* adjoining to the piezoelectric generator support 18*b* and extending forward. The nozzle 9*c* of the ejection nozzle 9, FIGS. 1 and 7, is made of an electrically conductive material, and the nozzle 9*c* is backward biased with a compressed spring 9*b* all the time. When the nozzle 9*c* is pushed forward by a "Y"-shaped operating lever 19 later described, the valve rubber 9*d* is moved apart from the valve seat 9*e*, thus opening the valve. A wick 9*f* is wet with the liquefied gas in the reservoir, and the gas enters an apertured filter 9*h* through the slots (not shown) of a headed article 9*g*. The apertured filter 9*h* stores liquefied gas, which leaks through the space between the nozzle bottom 9*i* and the shank of the headed article 9*g* and the space between the outer circumference of the nozzle 9*c* and the nozzle bottom 9*i*, through the lateral channel 9*j* and into the nozzle 9*c*, and finally it ejects from the tip end of the nozzle. As shown, a gasket 20** of an elastomer material is fixed to the tip end of the nozzle.

An operating lever 19 is made of an electrically conductive material, and an axis **19*a* integrally connected to the lever body is put in the hole made in the lever support 18*c* of the bracket 18. Thus, the lever 19 is rotatably fixed to the bracket . One end of the lever is fixed around the neck of the nozzle 9*c* of the ejection nozzle 9, and the other slant end 19*b* of the lever faces the ground or minus terminal 10*b* of the piezoelectric generator mechanism 10. With this arrangement the forward push of the operating cap 17 as indicated by arrow will cause ejection of liquefied gas into the conduit 13**.

Figure 3:
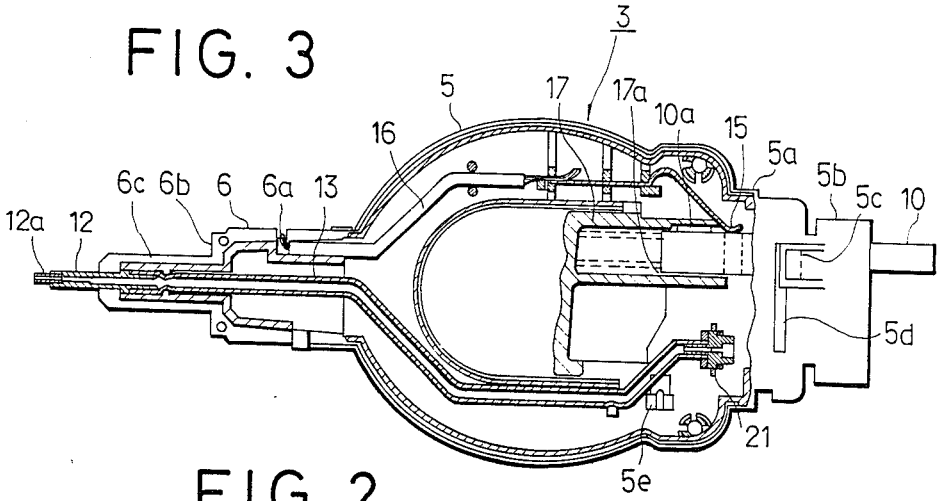
FIG. 3 shows, partly in section, the ignition mechanism section removed from the igniter.

FIG. 3 shows, partly in section, the main part of the ignition mechanism 2. As shown, the ignition mechanism 2 is contained in a rounded casing section 5, which has an elongation 6 extending from the rounded casing section 5. The ignition mechanism casing section comprises two longitudinally split casing counterparts, one of which is shown in FIG. 1. Each casing counterpart has a joint **5*b* provided to the rear end 5*a* of the rounded casing section 5. Specifically, the joint 5*b* extends from the base portion 5*a* (oval in section) of the rounded casing section 5, and it has a square nail catch 5*c* cut and inward bend from the joint plate 5*b*, and a cross slot 5*d* made therein. The cross ridge (not shown) of the reservoir casing will snap in the cross slot 5*a* of the ignition mechanism casing, and the nail catch 5*c* of the reservoir casing will be caught in the square recess 11*c*** of the reservoir casing when both casings are combined together.

On one side of the ignition casing section a conduit 13 extends from the tip end of the ejection nozzle 9 to the ignition nozzle 12, whereas on the other side of the ignition casing section a plus lead conductor 16 and associated terminal 15 extends from the plus terminal **10*a* of the piezoelectric generator mechanism 10 to the metal hollow cylinder 14. The operating cap 17 which is fitted around the head of the ignition mechanism 10, is partly appears from the rounded casing section, and is movable therein. Specifically, the rear end of the piezoelectric generator mechanism 10 is put into the recess support 18*b*, and the forward end of the piezoelectric generator mechanism 10 is put into the recess support 17*a* of the cap 17. The piezoelectric generator is forward biased by a compressed spring (not shown) all the time. With this arrangement a backward push to the cap as indicated by arrow in FIG. 1 will cause the plus terminal 10*a* to displace and enter contact with the terminal 15 of the plus lead conductor 16, and hence the metal hollow cylinder 14 as is apparent below. The cap can be locked by operating a stopper 5*e***.

The rear end of the conduit 13 is fitted on the tip end of a hollow joint 21 which is made of an electrically conductive material, and is fitted around the nozzle **9*c*. The forward end of the conduit 13 is fitted on the rear end of the ignition nozzle 12**.

The forward end of the plus lead conductor 16 extending from the terminal 15 is connected to the metal hollow cylinder 14 after passing through a window **6*a* made in the elongation 6** of the rounded casing section.

The ignition nozzle 12 is oval in section, and is made of a good electrically conductive metal. It has a tip piece **12*a* encircled by an inner protecting hollow cylinder 22 and an outer metal hollow cylinder 14. The nozzle tip 12***a* has an inner channel and a plurality of longitudinal slits (not shown) for gas ejection.

Figure 6:
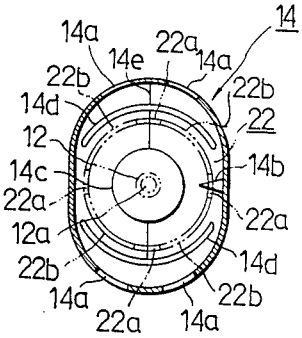
FIG. 6 is a sectional view taken along the line "Y'-'—"X" in FIG. 5.
Figure 5:
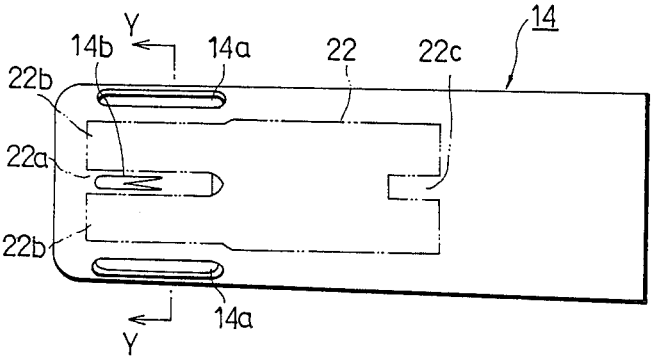
FIG. 5 is a side view of a protecting hollow cylinder.

FIG. 5 is a side view of the outer metal hollow cylinder, and FIG. 6 is a sectional view taken along the line "Y"—"Y" in FIG. 5.

The metal hollow cylinder 14 has four longitudinal ventilation holes 14*a* and an ignition electrode 14*b* cut and inward bent from the adjoining flat between two ventilation holes 14*a*. The top plate of the metal hollow cylinder has a center hole 14*c* in alignment with the tip end of the ignition nozzle and two arc slits 14*d* concentric with the center hole. The metal hollow cylinder 14 is made of metal plate, and two longitudinal split counterparts are integrally connected to each other along the lines 14*e*, and the so combined unit is fitted around the elongation 6 of the rounded casing section. Each longitudinal ventilation hole 14*a* is substantially equal to the length of the ignition nozzle extending from the elongation 6. The longitudinal ventilation holes 14*a*are made in the semicircular side sections, and a pointed projection 14*b* is provided in one of the flat side sections.

The inner protecting hollow cylinder 22, circular in section, is made of a refractory material. It has ventilation slots 22*a* open on its top circumference. These open slots are made in such a staggering relationship to the ventilation holes 14*a* of the outer metal hollow cylinder 14 that the adjoining portions 22*b* between adjacent ventilation slots 22*a* may face the ventilation holes 14*a* of the outer metal hollow cylinder 14. The protecting hollow cylinder 22 has two slots 22*c* on the bottom circumference, and it is fitted around the part of reduced diameter 6*c* of the elongation 6 to rest on the shoulder 6*b* of the elongation 6 with projections (not shown) of the elongation inserted in the bottom slots 22*c* of the projecting hollow cylinder 22.

In assembling different parts into a rod-shaped piezoelectric igniter, a reservoir section 1 and an ignition mechanism section 2 are automatically assembled in respective automatic production lines, and finally these sections are connected at their joints 5*b*, putting the rear end of the piezoelectric mechanism in the reservoir section in proper position. The rear end of the conduit 13 is connected to the tip end of the nozzle 9*c* of the ejection valve 9. Thus, assembling is completed.

In use, the hollow cylinder casing section 1 is held in hand, and the cap 17 is pushed with finger to displace the positive terminal pusher 10*a*, the same time the lever push or minus terminal 10*b*. Then, the positive terminal pusher 10a enters into contact with the positive terminal 15, and at the same time the minus terminal 10*b* pushes the slant surface 19*b* operating lever 19. The nozzle 9*c* of the ejection valve 9 is displaced forward, thereby allowing gas to flow in the hollow joint 21 and the conduit 13 and eject from the slits made in the circumference of the nozzle tip 12*a*. On the other hand, the voltage generated by the piezoelectric generator 10 is applied to the inner projection 14*b* metal hollow cylinder 14 through the positive terminal 15 and the positive lead 16 to cause electric discharge or electric arc between the nozzle tip 12*a* inner projection 14*b* metal hollow cylinder 14, thereby burning gas. When the reservoir 7 is filled with liquefied gas, it can be supplied from a liquefied gas container (not shown) by applying the gas container to the inlet valve 8.

As described above, a rod-shaped piezoelectric igniter according to the present invention comprises a reservoir section containing a tank equipped with a lever-operated ejection nozzle, and an ignition mechanism section having an ignition nozzle functioning as an ignition electrode provided at its tip end and joint means provided at its bottom end, thereby permitting integration of the reservoir and ignition mechanism sections.

The reservoir and ignition mechanism sections can be automatically assembled in existing productive facilities without difficulty. These sections can be integrally connected simply by inserting the reservoir section in the ignition mechanism section with the rear end of the gas conduit fitted in the tip end of the ejection nozzle. Thanks to the use of the gas conduit and the lever as a substitute for a minus or ground conductor no extra conductor is necessary, accordingly reducing the number of required parts and assembling steps, and hence the manufacturing cost involved.

I claim:

1. A rod-shaped piezoelectric igniter comprising: a reservoir casing having joint means; two longitudinal split casing counterparts to be together combined and a metal hollow cylinder having an electrode projecting inward, said metal hollow cylinder being fixed to one end of the combined casing counterparts, the other end of the combined casing counterparts having counter joint means for releasably coupling with the joint means of the reservoir casing; a liquefied gas reservoir section contained in the reservoir casing and equipped with an ejection valve, which is responsive to operation of a lever for ejecting gas; a lever for operation of said ejection valve and an ignition mechanism section contained in the combined casing counterparts and the metal hollow cylinder, said ignition mechanism section including an ignition nozzle functioning as an igniting electrode in the opposite relationship with a counter electrode projecting inward from said metal hollow cylinder, a piezoelectric generator mechanism partly extending into the reservoir casing and partly exposed for access thereto for pressing operation, a minus terminal of the piezoelectric generator responsive to the pressing operation of said ejection valve operating lever, an electrically conductive conduit connected to said ignition nozzle at one end of the conduit, and a lead conductor connected to said metal hollow cylinder at one end of the lead conductor and to a plus terminal of the piezoelectric generator mechanism at the other end of said lead conductor, thus permitting integration of the liquefied gas reservoir section and the ignition mechanism section with the rear part of the piezoelectric generator mechanism fitted in the reservoir section in proper position, and with the other end of the electrically conductive conduit connected to the tip end of an ejection nozzle, whereby the piezoelectric generator mechanism is responsive to a push for ejecting gas from the ejection nozzle and at the same time causing the minus terminal of said generator to enter into electric contact with the electrically conductive conduit through the operation of said ejection valve lever.

2. A rod-shaped piezoelectric igniter according to claim 1, wherein said joint means of said reservoir casing comprises a square nail projection and an elongated cross recess, and said counter joint of said other end of said combined casing counterparts comprises a square recess and an elongate cross ridge.

* * * * *